US005624255A

United States Patent [19]

Hisada et al.

[11] Patent Number: 5,624,255

[45] Date of Patent: Apr. 29, 1997

[54] MULTIPURPOSE CONTROLLED ATMOSPHERE HEAT TREATMENT SYSTEM

[75] Inventors: Hideo Hisada; Naoji Hamasaka, both of Osaka; Hayao Takahashi; Junji Mizoguchi, both of Ishikawa, all of Japan

[73] Assignee: Kabushiki Kaisha Komatsu Seisakusho, Tokyo, Japan

[21] Appl. No.: 424,543

[22] PCT Filed: Dec. 1, 1993

[86] PCT No.: PCT/JP93/01747

§ 371 Date: Jun. 1, 1995

§ 102(e) Date: Jun. 1, 1995

[87] PCT Pub. No.: WO94/13841

PCT Pub. Date: Jun. 23, 1994

[30] Foreign Application Priority Data

Dec. 4, 1992 [JP] Japan ..... 4-325771

[51] Int. Cl.[6] ..... F27B 9/02

[52] U.S. Cl. ..... 432/128; 432/152; 432/198

[58] Field of Search ..... 432/128, 137, 432/152, 159, 198, 200

[56] References Cited

U.S. PATENT DOCUMENTS 5,052,923 10/1991 Peter et al. ..... 432/128

FOREIGN PATENT DOCUMENTS 51-35673 3/1976 Japan .
55-46754 11/1980 Japan .
60-159586 8/1985 Japan .
60-190511A 9/1985 Japan .
60-208469 10/1985 Japan .
2-502930 9/1990 Japan .

*Primary Examiner*—Noah P. Kamen

*Attorney, Agent, or Firm*—Nikaido, Marmelstein, Murray & Oram LLP

[57] ABSTRACT

A multipurpose controlled atmosphere heat treatment system applicable to small-quantity production of multiple items as well as mass-production. A delivery path is provided so as to pass through a workstation and the heat treatment system and an automatic guided vehicle travels along this delivery path. The automatic guided vehicle shuts out external air, comprises a holding chamber in which an inert gas atmosphere can be created, and shifts workpieces from an elevator provided in a high-rise warehouse into treatment cells. Each treatment cell has a sealing door on the side confronting to the automatic guided vehicle and pipes and various devices on a back face, ceiling or front face thereof.

11 Claims, 8 Drawing Sheets

MULTIPURPOSE CONTROLLED ATMOSPHERE HEAT TREATMENT SYSTEM

TECHNICAL FIELD

The present invention relates to a multipurpose controlled atmosphere heat treatment system of an energy saving type which is capable of flexibly performing various types of heat treatment such as carburizing, nitriding and hardening.

BACKGROUND ART

Generally, heat treatments such as carburizing, nitriding, soft nitriding, carbonitriding, oxidation, cleaning, hardening, tempering and normalizing are energy-consuming processes which require a long time and a high temperature to carry out. In view of productivity and flexibility concerns, various energy-saving type furnaces have been proposed and put to practical use as heat treatment equipment for performing such heat treatments.

Conventional heat treatment equipment is classified into three major categories: (1) continuous-type furnaces, (2) batch-type furnaces and (3) rotary furnaces.

One continuous-type furnace is disclosed in Japanese Unexamined Patent Publication No. 60-208469 (1985) according to which trays on which workpieces to be processed are loaded and are put into a furnace by a pusher or conveyor at specified intervals. These trays sequentially pass through a heating zone, carburizing zone, diffusion zone, and cooling zone, whereby the workpieces undergo each treatment in sequence.

Batch-type furnaces are designed to have independently installed treatment cells such as a carburizing furnace cell, a tempering furnace cell or a cleaning cell. These cells are connected by an automatic delivery system. Travel of the automatic delivery system and shifting of workpieces between the automatic delivery system and the treatment cells are controlled by a computer.

One type of rotary furnace is disclosed in Japanese Unexamined Patent Publication No. 2-502930 (1990) (deriving from a PCT application) according to which a plurality of trays on which workpieces are loaded are put into the rotary furnace at the same time. During carburizing operation, a hearth is rotated and the trays carrying the workpieces which have been carburized over a specified period are delivered to the diffusion zone.

The above-described continuous-type furnaces do not bring about heavy energy losses but ensure high productivity because there is no need to lower or raise the temperature of the furnace. They, however, present the disadvantage that when changing treatment conditions, it is necessary to change atmosphere and temperature with a dummy tray put in the furnace thus uselessly consuming energy for a long time. In addition, the amount of production cannot be flexibly changed. Another drawback they have is during maintenance of the system, that is, since the treatment zones are built in series, in the event of a failure in a part of the system, the whole line is stopped.

The batch furnaces can be applied to small-quantity production of multiple items and can flexibly control the amount of production because of their completely independent treatment cells. Further, even if trouble occurs in a part of the system, it has a comparatively small influence upon the entire system. However, they also present several disadvantages. First, provision of many independent furnace cells leads to high cost. Second, they present poor energy efficiency, since carburizing furnaces are provided with their own hardening oil tanks and these oil tanks are idle very often as hardening time is short compared to carburizing time.

On the other hand, the rotary furnaces are composed of one furnace so that treatment time can be controlled easily. In these furnaces, the diffusion zone can be constructed in the form of a rotary hearth. A disadvantage of the rotary furnaces is that furnace atmosphere is kept constant and therefore carburizing and nitriding for example, or heat treatments which differ from each other in carburizing temperature cannot be carried out simultaneously. To change furnace atmosphere, it is necessary to run the furnace without loading workpieces, which obviously wastes energy. Another disadvantage is that the furnace itself is large in size and has a complicated structure so that in the event of trouble, not only troubleshooting is difficult but also the trouble markedly affects the whole line. Further, temperature and atmosphere vary considerably in the rotary furnaces.

Each of the prior heat treatment systems has both merits and demerits and therefore these systems are used according to their characteristics, for small-quantity production of multiple items or mass-production etc. In such circumstances, there has been a longstanding demand for development of a multi-purpose controlled atmosphere heat treatment system which can manufacture articles in various amounts.

OBJECT AND SUMMARY OF THE INVENTION

The invention has been made taking the above problems into account. One of the objects of the invention is therefore to provide a multipurpose controlled atmosphere heat treatment system which is not only provided with the flexibility inherent to batch-type furnaces and productivity inherent to continuous-type furnaces but also can be satisfactorily used for both mass-production and small-quantity production of multiple items.

The foregoing object can be achieved by a multipurpose controlled atmosphere heat treatment system according to the invention, the system comprising:

(a) at least one automatic guided vehicle for delivering workpieces, which is so constructed as to shut out external air and has a holding chamber in which an inert-gas atmosphere can be created;

(b) a plurality of treatment cells arranged along a traveling path for the automatic guided vehicle, in each of which a unit heat treatment process is carried out;

(c) shifting means for shifting the workpieces from each of the treatment cells to the automatic guided vehicle or vice versa; and (d) a control unit for controlling travel of the automatic guided vehicle and shifting of the workpieces by the shifting means.

Examples of the unit heat treatment processes are cleaning, degreasing, carburizing, carbonitriding, nitriding, soft nitriding, oxidation, hardening, tempering, normalizing and cooling.

In such a multipurpose atmosphere heat treatment system, after workpieces have been loaded in the holding chamber of the automatic guided vehicle, an inert gas such as nitrogen gas is introduced into the holding chamber to create an inert-gas atmosphere in the holding chamber. The automatic guided vehicle travels to a position in front of a desired treatment cell and then the workpieces are shifted from the holding chamber into the treatment cell, while external air is shut off from the holding chamber and from the treatment cell. Thereafter, the workpieces are subjected to a unit heat treatment process such as carburizing and then shifted again from the treatment cell back into the holding chamber, while external air is again shut off. After a plurality of unit heat treatment processes have been performed on the workpieces sequentially in a specified order, the workpieces are delivered by the automatic guided vehicle to outside of the system. With this arrangement, various types of heat treatment can be flexibly carried out to produce multiple items in small amounts. Because the delivery of workpieces takes place in a non-oxidizing atmosphere, oxidation, decarbonization, denitrification etc. can be prevented to ensure that the products have improved surface quality.

The holding chamber may have a wall that is formed from a heat-insulating material and outer jacketing lagging. This wall can be heated to and kept at a specified temperature by an incorporated heater. This prevents a decrease in the temperature of the workpieces during delivery, so that the quality of the workpieces can be kept constant.

The holding chamber may be provided with sealing doors on the sides facing the treatment cells, which enables the chamber to securely transport the workpieces between each treatment on the workpieces under an inert-gas atmosphere.

To create an inert-gas atmosphere in the holding chamber, the automatic guided vehicle may comprise an inert-gas feeder for introducing inert gas into the holding chamber. Inert gas is introduced into the holding chamber so that any gas which penetrates into the holding chamber from outside can be diluted, thus maintaining an inert-gas atmosphere. Alternatively, the automatic guided vehicle may be equipped with a vacuum-purging device for vacuum-purging the holding chamber and the inert-gas feeder for introducing inert gas into the holding chamber. In this case, after the holding chamber has been vacuum-purged by the vacuum-purging device, inert gas is then introduced into the holding chamber by the inert-gas feeder, whereby an inert-gas atmosphere can be maintained in the holding chamber.

Each treatment cell may comprise (i) a sealing door on the side facing the automatic guided vehicle, (ii) a vacuum-purging device for vacuum-purging the treatment cell and (iii) an insert-gas feeder for introducing inert gas into the treatment cell. This also ensures that various types of heat treatment are performed on the workpieces under an atmosphere of inert-gas.

Preferably, each treatment cell has, on the back face, ceiling or front face thereof, pipes and various devices for creating a desired atmosphere in the treatment cell and for controlling that atmosphere. Such arrangement eliminates the need for the provision of pipes attached to the sides of each treatment cell, so that a plurality of treatment cells can be disposed close to one another or the treatment cells can be attached to one another particularly in the case of treatment cells where treatment of the same kind is carried out. This advantageously reduces the space occupied by the entire heat treatment system. Further, it is preferable that the treatment cells are designed to be independently detachable so that they can be removed or added, which further improves the flexibility of the heat treatment system.

Representative examples of the treatment cells are heating furnace cells, carburizing furnace cells, nitriding furnace cells, oxidation furnace cells, tempering furnace cells, annealing furnace cells, cooling furnace cells, oil tank cells, water tank cells, salt cells, and cleaning furnace cells.

Each treatment cell may include therein a hardening oil tank. A hardening holding furnace cell for keeping the workpieces at a specified hardening temperature for a specified time may be used as the treatment cell. This enables more effective treatment for the workpieces.

The shifting means may be disposed in the holding chamber and designed as a chain mechanism equipped with a pusher for pushing a tray on which the workpieces are loaded.

BRIEF DESCRIPTION OF THE DRAWINGS

Other objects of the present invention will become apparent from the detailed description given hereinafter. However, it should be understood that the detailed description and specific example, while indicating preferred embodiments of the invention, are given by way of illustration only, since various changes and modifications within the spirit and scope of the invention will become apparent to those skilled in the art from this detailed description.

DETAILED DESCRIPTION AND BEST MODE FOR CARRYING OUT THE INVENTION

Figure 1:
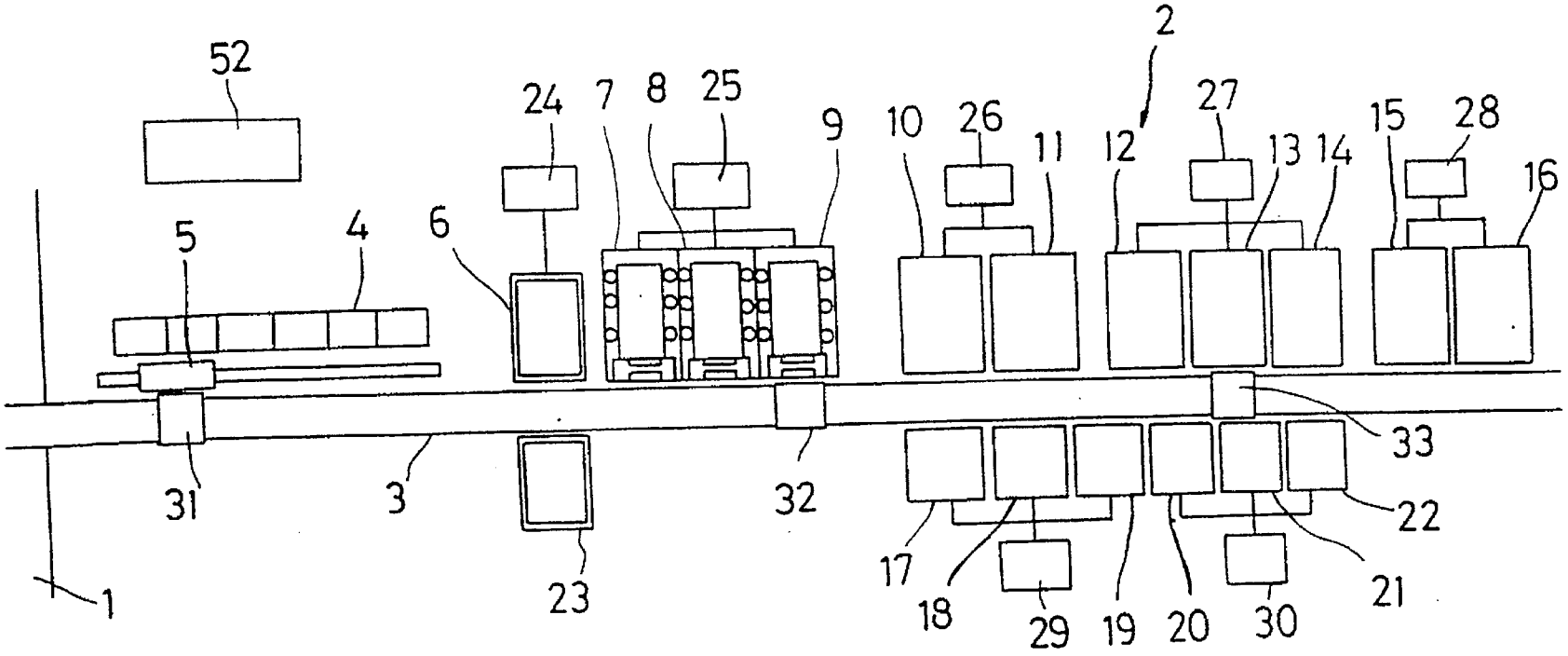
FIG. 1 is a plan view schematically showing the construction of a first embodiment of the multipurpose controlled atmosphere heat treatment system according to the invention.

Referring now to the drawings, preferred embodiments of a multipurpose controlled atmosphere heat treatment system according to the invention will be described.

Referring to FIG. 1 which illustrates a first embodiment of a multipurpose controlled atmosphere heat treatment system, a workstation 1 and a heat treatment system 2, respectively are provided. A delivery path 3 extends linearly passing through the workstation 1 and heat treatment system 2. The heat treatment system 2 has a high-rise warehouse 4 near the exit of the workstation 1 and the high-rise warehouse 4 is equipped with an elevator 5 for use in a high-rise warehouse (stacker crane) that is designed to be movable along the delivery path 3.

The heat treatment system 2 comprises a number of unit heat treatment cells (hereinafter referred to as "treatment cells") 6 to 23 that are arranged on both sides of the delivery path 3 so as to be close to one another. These treatment cells 6 to 23 are connected to vacuum exhaust systems 24 to 30.

Treatment cell 6 is a pre-cleaning cell (immersion cleaning tank) provided with a tank for storing a cleaning solvent and an elevator for carrying workpieces placed thereon. This treatment cell 6 preliminary cleans the workpieces having high-boiling point greases adhered thereon.

Treatment cells 7, 8 and 9 are carburizing furnace cells provided with a heater for heating the furnace to a specified temperature and with a pipe for introducing carburizing gas into the furnace so that a desired atmosphere can be created. As a carburizing gas, the gas generator can use RX gas as the introduced gas or can use the alcohol dropping method.

Treatment cells 10, 11 are soaking furnace cells for maintaining the workpieces at a specified temperature.

Treatment cells 12, 13, 14 are nitriding furnace cells provided with a heater and gas pipes for nitriding treatments such as nitriding with ammonia and soft nitriding. Different nitriding treatments, for example, gas nitriding and gas soft nitriding, can be carried out in each of the treatment cells, 12, 13, 14.

Treatment cells 15 and 16 are tempering cells provided with a heater and designed to carry out tempering in an atmosphere of nitrogen.

Treatment cells 17, 18, 19 are hardening oil tank cells. More concretely, the treatment cells 17, 18, 19 are a cold oil tank cell, semi-hot oil tank cell and hot oil tank cell, respectively. In these treatment cells 17, 18, 19, the kind of oil to be used can be changed according to the distortion or case depth of the workpieces. These oil tanks are respectively provided with a vacuum exhaust system so that high cooling capability can be achieved by the use of only one tank and one kind of oil, utilizing the fact that the cooling capability of oil increases under reduced pressure even in the case of hot oil.

Treatment cells 20, 21, 22 are cooling cells. Specifically, the treatment cells 20, 21, 22 are a water tank cell, salt cell and air-cooling cell, respectively. The kind of hardening medium can be selected as required.

Treatment cell 23 is a post cleaning cell functioning substantially similarly to the pre-cleaning cell 6 described earlier.

The number and capacity of treatment cells are determined according to production and treatment patterns and if additional cells are required, they may be installed along the delivery path 3.

First to third automatic guided vehicles 31, 32, 33 for delivering a tray on which the workpieces are loaded travel in the delivery path 3. The first automatic guided vehicle 31 delivers a tray, which carries workpieces which have been pre-treated in the workstation 1, to the high-rise warehouse 4 and shifts this tray onto the elevator 5. The first automatic guided vehicle 31 also receives a tray, which carries treated workpieces and has been stored in the high-rise warehouse 4, from the elevator 5 and delivers it for a post treatment. The second or third automatic guided vehicle 32 (33) delivers a tray taken out of the high-rise warehouse 4 by the elevator 5 to one of the treatment cells 6 to 23 of the heat treatment system 2. The vehicle 32, (33) then shifts the tray to the treatment cells 6 to 23 and receives in turn a tray which has been heat-treated in the treatment cells 6 to 23 in order to deliver to the elevator 5.

Figure 2:
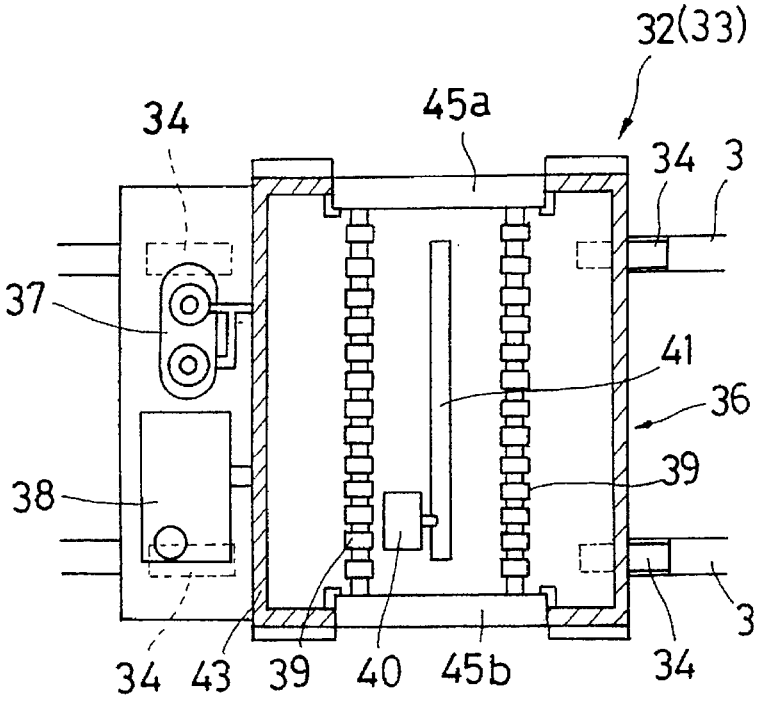
FIG. 2 is a sectional plan view of an automatic guided vehicle.
Figure 3:
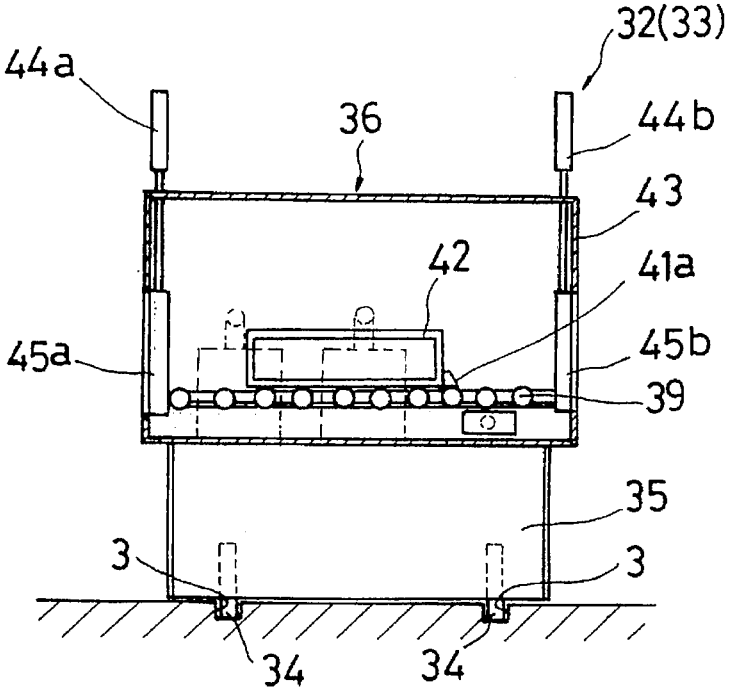
FIG. 3 is a sectional front view of the automatic guided vehicle.

As shown in FIGS. 2 and 3, each of the second and third automatic guided vehicles 32, 33 for transferring a tray between the treatment cells 6 to 23 comprises (i) a vehicle body 35 having four wheels 34 at the underside thereof, (ii) a holding chamber 36 disposed above the vehicle body 35, (iii) a vacuum exhaust system 37 for vacuum-exhausting the holding chamber 36 and (iv) an inert-gas feeder 38 (e.g., nitrogen gas container) for supplying inert gas to the holding chamber 36 to create a non-oxidizing atmosphere.

In the holding chamber 36, two rows of rollers 39 are provided in a transverse direction with respect to the delivery path 3. Disposed in the middle of the two rows of rollers 39 is a chain mechanism 41 having a pusher 41*a* and actuated by a motor 40 used for tray delivery. A tray 42 carrying workpieces is placed on the rollers 39 and pushed towards a predetermined position by the pusher 41*a* when the motor 40 is actuated.

The holding chamber 36 is covered with an adiabatic wall 43 and has, on the sides facing to the treatment cells 6 to 23, sealing doors 45*a*, 45*b* which can be freely opened and closed by cylinders 44*a*, 44*b*.

Figure 4:
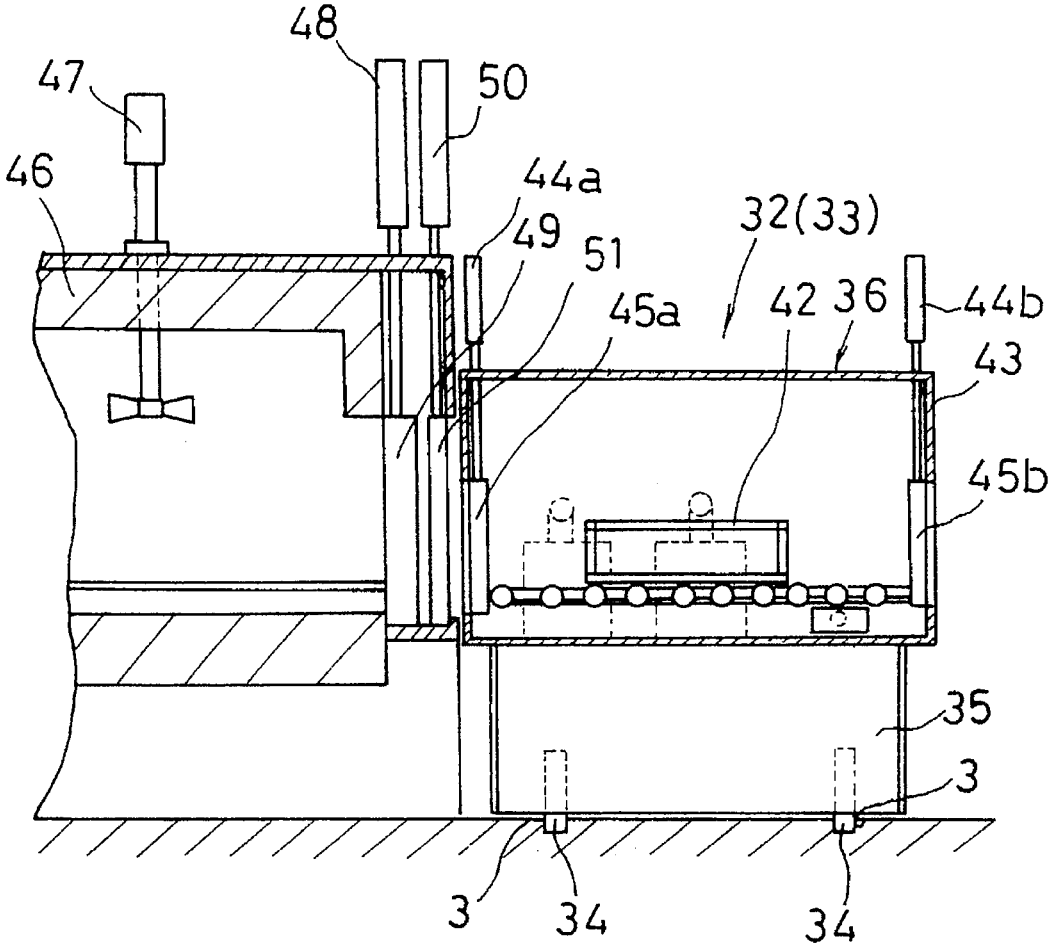
FIG. 4 is a sectional view showing the condition of a tray being shifted between the automatic guided vehicle and a treatment cell.

As shown in FIG. 4, each of the treatment cells 6 to 23, from and into which the tray 42 is shifted by the second or third automatic guided vehicle 32 (33), is covered with an adiabatic wall 46 and has an agitating fan 47 at its ceiling. Each of the treatment cells 6 to 23 also comprises an adiabatic door 49 and a sealing door 51 on the side facing to the delivery path 3. The adiabatic door 49 is freely opened and closed by a cylinder 48, while the sealing door 51 is freely opened and closed by a cylinder 50 and disposed outside of the adiabatic door 49.

In each treatment cell, electric wires and gas pipes for creating a desired atmosphere are not attached to the side faces but collectively attached to the ceiling, back face or front face of the cell.

The first automatic guided vehicle 31 does not have the structure of the holding chamber and adiabatic wall etc. as provided in the second and third automatic guided vehicles 32, 33 but required only the function of shifting the tray 42 to and from the elevator 5.

As shown in FIG. 1, the heat treatment system 2 comprises a control unit 52 for controlling and managing the whole heat treatment system 2. The control unit 52 controls the furnace temperature, oil tank temperature and atmosphere of each of the treatment cells 6 to 23. It also controls travel of the first to third automatic guided vehicles 31 to 33 and shifting of workpieces by these vehicles.

Next, shifting of the tray 42 in the heat treatment system 2 having the above-described construction will be described.

First, workpieces which have been pre-treated in the workstation 1 are loaded on the tray 42 and delivered to the front of the high-rise warehouse 4 by the first automatic guided vehicle 31. Afterwards, the workpieces are shifted onto the elevator 5 and then put in a specified shelf in the high-rise warehouse 4 by this elevator 5.

When the workpieces on the tray 42 are to be treated, the tray 42 is taken out of the high-rise warehouse 4 by the elevator 5 and loaded onto the second or third automatic guided vehicle 32 (33). The automatic guided vehicle 32 (33) having the tray 42 mounted thereon travels automatically to the front of a predetermined cell.

When the second or third automatic guided vehicle 32 (33) comes to the front of the predetermined cell, the treatment cell and the holding chamber 36 are evacuated by their corresponding vacuum exhaust systems 24 to 30 and 37. Nitrogen gas is then introduced into the treatment cell and holding chamber 36 as the inert gas. In this case, the pressure of the nitrogen gas is set higher than atmospheric pressure.

Thereafter, the adiabatic door 49 and sealing door 51 of the treatment cell as well as the sealing door 45*a* of the automatic guided vehicle 32 (33) which is positioned on the side confronting the treatment cell are opened at the same time. Although the treatment cell and the holding chamber 36 are not in sealing contact, atmospheric air does not penetrate into the treatment cell nor the holding chamber 36 since the pressure of the nitrogen gas is set higher than atmospheric pressure. This eliminates problems such as oxidation of the workpieces.

The tray 42 is pushed into the treatment cell by the pusher 41*a* driven by the motor 40. After the tray 42 has been pushed to a specified position in the treatment cell, the pusher 41*a* returns to its home position and the adiabatic door 49, sealing doors 51, 45*a* are all closed.

After the treatment cell has been evacuated once and temperature is restored, a prescribed gas (e.g., carburizing gas in the case of carburizing) is supplied to commence the treatment. In the meantime, the automatic guided vehicle 32 (33) travels to the front of another treatment cell and stands by for another treatment.

When the tray 42 is shifted from the treatment cell into the holding chamber 36, the treatment cell is filled with nitrogen gas at a pressure higher than atmospheric pressure after evacuating the treatment cell. The tray 42 is then transferred into the holding chamber 36 which is also filled with nitrogen.

Figure 5:
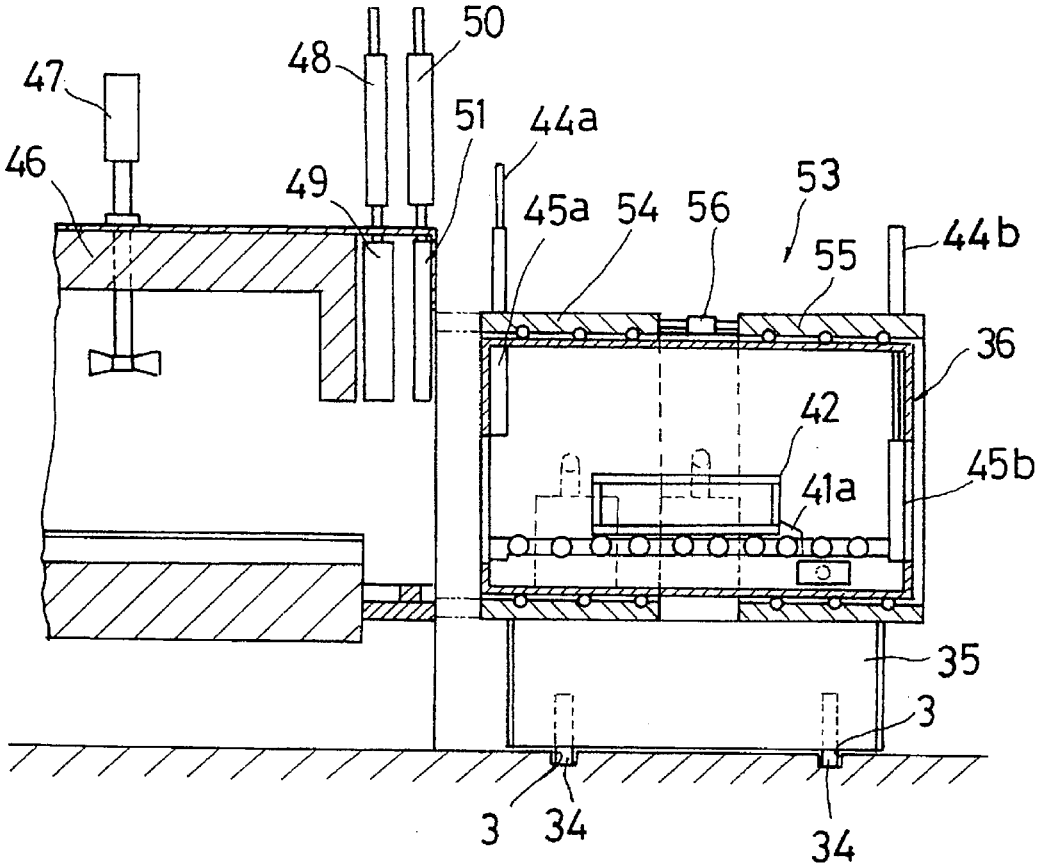
FIG. 5 is a sectional view showing the condition of the tray being shifted by the use of an automatic guided vehicle according to an alternate.

FIG. 5 shows an alternative of the automatic guided vehicle for transferring the tray between the treatment cells 6 to 23. An automatic guided vehicle 53 according to the alternative comprises two sliding tubes 54, 55 which cover the outer wall of the holding chamber 36 and are slidable towards the treatment cells. An air cylinder 56 for sliding the sliding tubes 54, 55 is attached to the ceiling wall of the holding chamber 36.

When the automatic guided vehicle 53 reaches in front of a specified treatment cell, the sliding tube 54 on the side of the treatment cell is stretched in a direction towards the treatment cell as indicated by two-dot chain line in FIG. 5 by the operation of the air cylinder 56, so that the tube 54 comes in close contact with the front face of the treatment cell, preventing the penetration of atmospheric air.

The sealing door 45*a* of the automatic guided vehicle 53 is then opened, and the adiabatic door 49 and sealing door 51 of the treatment cell are opened while air present in the space enclosed by the stretched sliding tube 54 being discharged through an exhaust hole (not shown) formed in a part of the sliding tube 54. Sequentially, the tray 42 is shifted into the treatment cell, being pushed by the pusher 41*a*. After the tray 42 has been pushed to a specified position in the treatment cell, the pusher 41*a* returns to its home position and sequentially, the adiabatic door 49, sealing doors 51 and 45*a* are closed while the sliding tube 54 returning to its home position.

In cases where shifting of the tray 42 is carried out using the automatic guided vehicle 53, if there is spare time, it is possible to employ an arrangement in which after the sealing door 45*a* of the automatic guided vehicle 53 has been opened with the sliding door 54 in sealing contact with the front face of the treatment cell, the holding chamber 36 as well as the treatment cell are entirely evacuated and thereafter nitrogen is introduced.

The multipurpose controlled atmosphere heat treatment system of the first embodiment prevents flammable gas (e.g., carburizing gas) and odorous gas (e.g., ammonia gas generated during nitriding) from escaping from the system, so that the oxidation, decarbonization and denitrification of the surfaces of the workpieces caused by direct contact with atmospheric air can be prevented. This not only prevents the deterioration of product quality but also contributes to safety as well as the conservation of the environment.

In addition, the multipurpose controlled atmosphere heat treatment system of the first embodiment can deal with various types of heat treatment so that it is particularly suited for use in the case where a small number of workpieces are subjected to various kinds of carburizing and nitriding treatment. The system has common oil tanks, which further improves the production efficiency of the system and therefore makes the system applicable to mass-production. The independently built treatment cells facilitate maintenance. Delivery and shifting of workpieces can be carried out without the use of a large-sized non-oxidizing atmospheric sealed room, which also contributes to easy maintenance of the delivery system.

Figure 6:
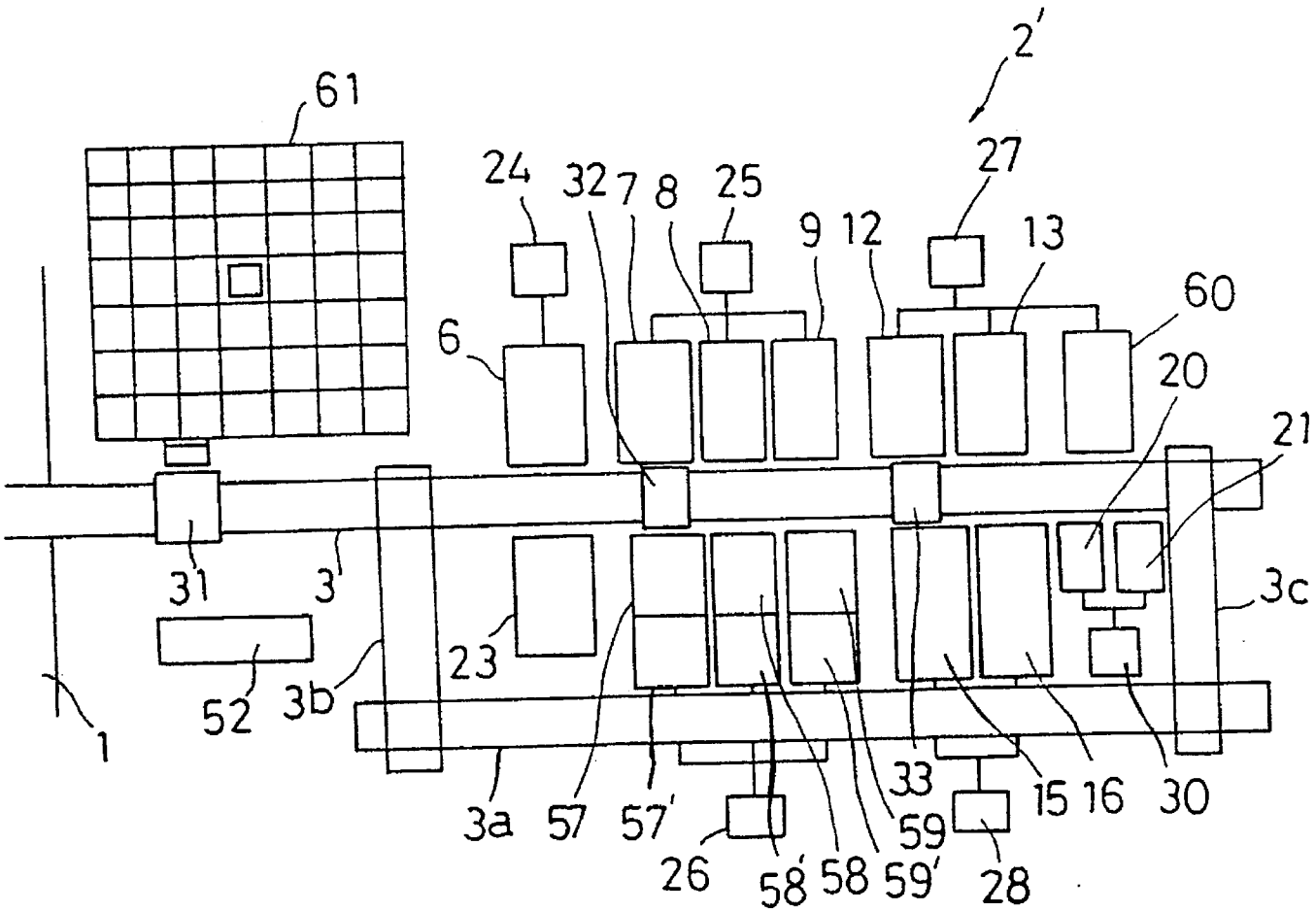
FIG. 6 is a plan view schematically showing the construction of a multipurpose controlled atmosphere heat treatment system according to a second embodiment of the invention.

FIG. 6 shows a multipurpose controlled atmosphere heat treatment system according to a second embodiment of the invention. In the description of the second embodiment, the parts that are substantially equivalent or function substantially similarly to the first embodiment will be indicated by the same numerals as those given to their counterparts in the first embodiment and explanation on these parts will be omitted.

In the heat treatment system 2' according to the second embodiment, soaking pits 57, 58, 59 are formed integrally with oil tanks 57', 58', 59' respectively as hardening, holding furnaces. A preliminary soaking pit cell 60 for water cooling and air cooling is disposed adjacently to the nitriding furnace cells 12, 13. Provided behind the oil tanks 57'58'59' is a delivery path 3*a* with which workpieces can be delivered, taken out of the oil tanks 57', 58', 59' through the sealing door provided on the opposite side to the soaking pits 57, 58, 59. In addition to the two delivery paths 3, 3*a*, there are provided another two delivery paths 3*b*, 3*c* each of which extends transversely of the parallel delivery paths 3, 3*a* so as to connect them. The second and third automatic guided vehicles 32, 33 comprise wheels that are movable in both vertical and lateral directions. In the second embodiment, a horizontal-type stock yard 61 is used for storing workpieces, in place of the high-rise warehouse in the first embodiment.

In the heat treatment system 2', hardening treatment is carried out in the following way, for example, after carburizing. After carburizing, the workpieces are delivered to the soaking pits 57, 58, 59 by the second or third automatic guided vehicle 32 (33) and held at a specified temperature in these pits 57, 58, 59 for a specified time. Then the workpieces are transferred into the oil tanks 57', 58', 59' for hardening, which are integrated with the soaking pits 57, 58, 59 respectively with doors therebetween. After hardening, the tray on which the workpieces are loaded is let out from the sealing door on the side opposite to the soaking pits and delivered to one of other cells for the next treatment (e.g., cleaning, tempering) by the second or third automatic guided vehicle 32 (33).

By the use of the heat treatment system of the second embodiment, the time required for transferring the workpieces from the soaking pits 57, 58, 59 to the oil tanks 57', 58', 59' can be reduced, so that hardening treatment can be carried out immediately after soaking.

The heat treatment system of the second embodiment does not have pipes, sensors and other devices on the side face of each treatment cell, so that the treatment cells can be so arranged to be close to one another, thereby reducing the space occupied by the system.

Figure 7:
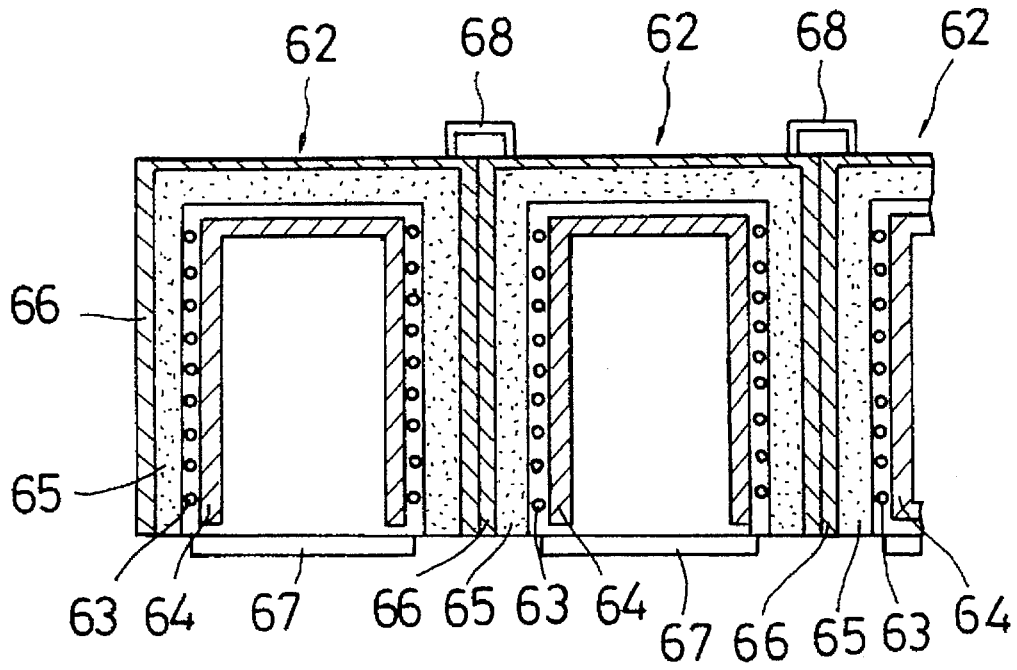
FIG. 7 is a sectional view showing the construction of a treatment cell according to one example of the invention.

FIG. 7 shows one example of the construction in which the treatment cells are closely arranged. In each of the treatment cells 62 in this example, there are provided a heater 63; an inner refractor 64 constituting the inner wall of the heater 63; and an outer refractor 65 constituting the outer wall of the heater 63. Each treatment cell 62 is covered with an outer jacketing lagging 66 that is made of steel sheets or the like and is disposed outside the outer refractor 65. The opening of the front face is covered with a sealing door 67. The successively arranged treatment cells 62 are coupled by coupling members 68 at their back faces such that the cells 62 can be independently separated or added.

Examples of heat treatment by the use of the heat treatment system 2 or 2' according to the foregoing embodiments will be concretely described.

Figure 8A:
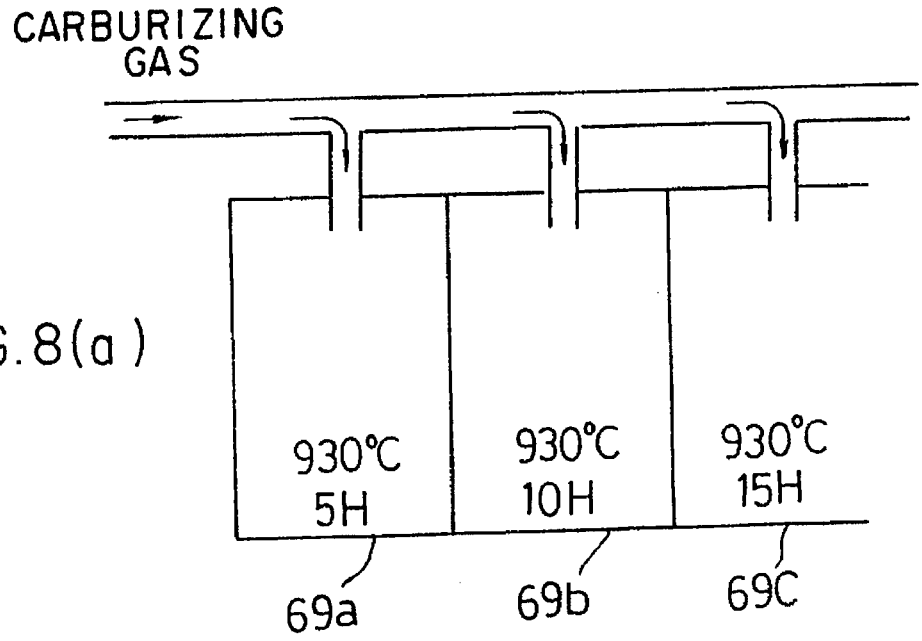
FIG. 8(*a*) and 8(*b*) illustrate heat treatment according to a first example of the invention.
Figure 8B:
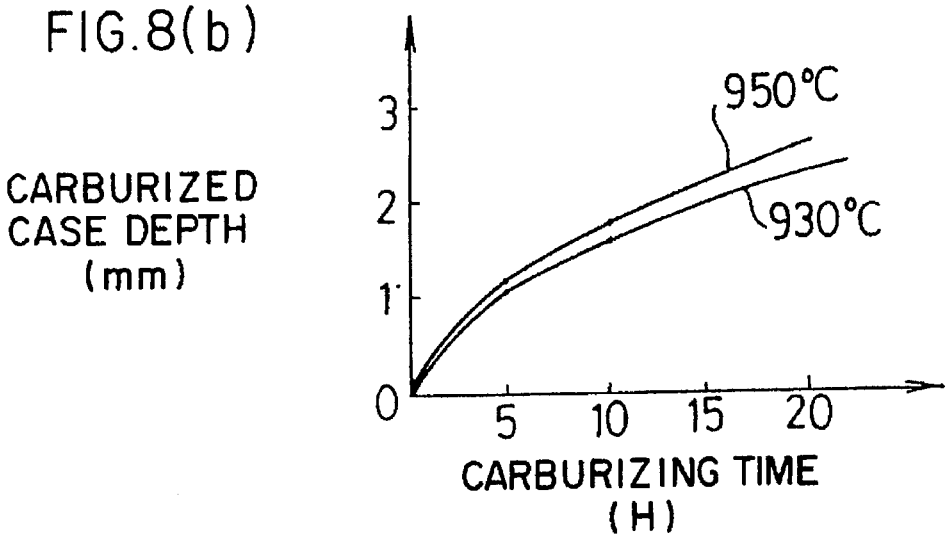

As shown in FIG. 8(*a*), the same carburizing gas is introduced into the successive treatment cells 69*a*, 69*b*, 69*c* and temperature and residence time are varied according to the cells, whereby products different in carburized case depth are produced in these cells. FIG. 8(*b*) shows the relationship between carburizing time and carburized case depth using carburizing temperature as a parameter. It is to be understood from FIG. 8(*b*) that products having a carburized case depth of 1.1 mm can be produced by carburizing workpieces at 930° C. over 5 hours in the first treatment cell 69*a*, and that products having a carburized case depth of 1.6 mm can be produced by carburizing workpieces at 930° C. over 10 hours in the second treatment cell 69*b*.

Figure 9A:
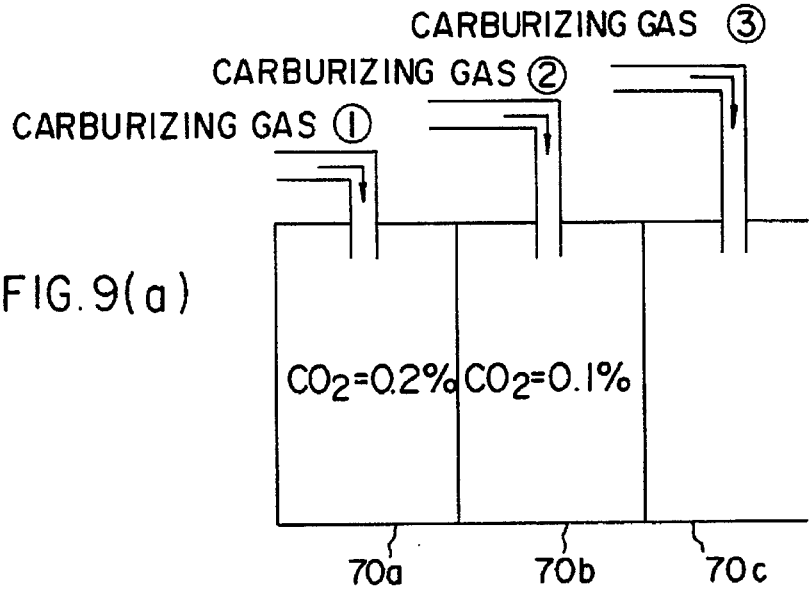
FIG. 9(*a*) and 9(*b*) illustrate heat treatment according to a second embodiment of the invention.
Figure 9B:
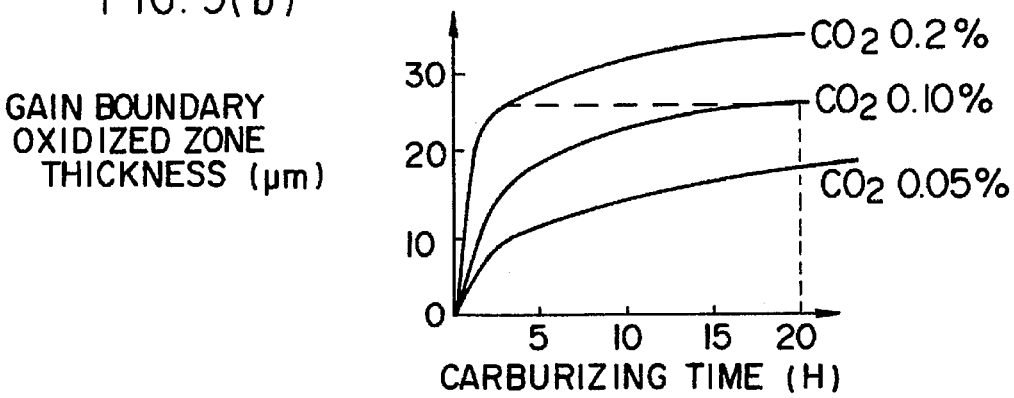

In consideration of the fact that as the $Co_2$ content of furnace atmosphere (i.e., carburizing gas) during carburizing increases, the thickness of the grain boundary oxidized zone (i.e., the product of the reaction between oxidizing element and oxygen) developed on the surface of a workpiece increases, carburizing gases having different $CO_2$ contents are introduced into the treatment cells 70*a*, 70*b*, 70*c* as shown in FIG. 9(*a*). More concretely, an atmosphere with low $CO_2$ content is created and carburizing time is shortened for articles which require high strength while an atmosphere with high CO content and high $CO_2$ content is created for articles which do not require high strength. In this manner, product quality and production cost are optimized as a whole. FIG. 9(*b*) shows the relationship between carburizing time and the thickness of the grain boundary oxidized zone using $CO_2$ content as a parameter. It is apparent from FIG. 9(*b*) that products having a 27 μm thick grain boundary oxidized zone are obtained from carburizing workpieces for 4 hours in the first treatment cell 70*a* filled with a gas having a $Co_2$ content of 0.2%, and that products having 25 μm thick grain boundary oxidized zone are obtained from carburizing workpieces for 20 hours in the second treatment cell 70*b* filled with a gas having a $CO_2$ content of 0.10%. In this way, products to be obtained in the treatment cells can be controlled to have the same thickness in their grain boundary oxidized zones by changing the composition of gases to be introduced into the treatment cells.

Figure 10:
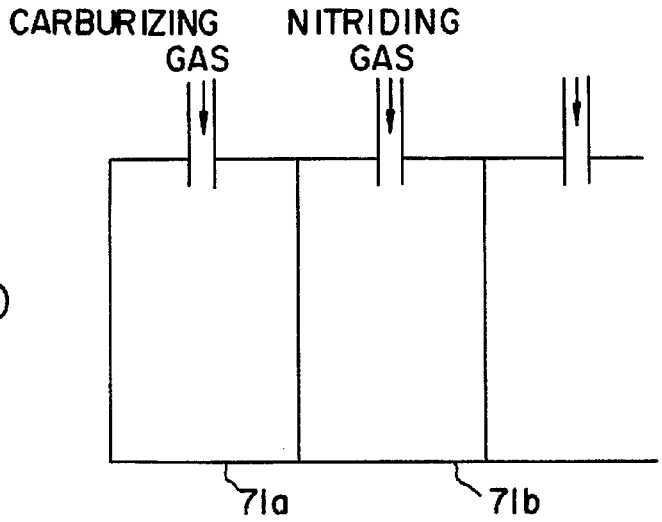
FIG. 10 illustrates heat treatment according to a third example of the invention.

In this example, as introduced gasses can vary from cell to cell, RX gas is introduced in the first treatment cell 71*a* for carburizing while ammonia is introduced into the second treatment cell 71*b* for nitriding as shown in FIG. 10. These cells are then heated to and kept at specified temperatures, whereby carburizing and nitriding are carried out at the same time.

It is obvious that the invention is not limited to the foregoing treatment examples but applicable to a variety of heat treatment patterns.

While the second and third automatic guided vehicles 32, 33 are equipped with the vacuum exhaust system 37 and the inert gas feeder 38 in the foregoing embodiments, these automatic guided vehicles 32, 33 may be designed without the vacuum exhaust system 37 but have only the inert gas feeder 38. In such a case, the inert gas feeder 38 supplies a sufficient amount of inert gas to the holding chamber 36 so that gas penetrating from outside (e.g., flammable gas and oxidant gas) can be diluted to create an inert gas atmosphere in the holding chamber 36

Further, the holding chamber 36 in the foregoing embodiments may be equipped with a heater for heating and keeping the holding chamber 36 at a specified temperature. This prevents a decrease in the temperature of the workpieces during delivery, thereby maintaining the quality of the workpieces.

INDUSTRIAL APPLICABILITY

The multipurpose controlled atmosphere heat treatment system according to the invention can be applied not only to small-quantity production of multiple items but also to mass-production, owing to its high production efficiency. Workpieces are delivered in a non-oxidizing atmosphere so that the oxidation, decarbonization and denitrification of the workpieces can be prevented, resulting in an improvement in surface quality. In addition, as each treatment cell is independently built, maintenance can be simplified. Another advantage is that workpieces can be delivered and transferred without the use of a large sealed room where non-oxidizing atmosphere is created. This facilitates delivery system maintenance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A multipurpose controlled atmosphere heat treatment system comprising:

(a) at least one automatic guided vehicle for delivering work-pieces, capable of shutting out external air and which has a holding chamber capable of maintaining an inert-gas atmosphere;

(b) a plurality of treatment cells arranged along a predetermined path along which the automatic guided vehicle travels, in each of which a unit heat treatment process is carried out;

(c) shifting means for shifting the workpieces between each of the treatment cells and the automatic guided vehicle; and (d) a control unit for controlling travel of the automatic guided vehicle and shifting of the workpieces by the shifting means.

2. The multipurpose controlled atmosphere heat treatment system as set forth in claim 1, wherein the holding chamber comprises a wall having a heat-insulating material and outer jacketing lagging, and a heater for heating and maintaining an interior of said chamber at a specified temperature.

3. The multipurpose controlled atmosphere heat treatment system as set forth in claim 1 or 2, wherein the holding chamber has sealing doors on sides facing the treatment cells along the predetermined path.

4. The multipurpose controlled atmosphere heat treatment system as set forth in claim 1, wherein the automatic guided vehicle further comprises an inert-gas feeder means for introducing inert gas into the holding chamber to dilute gas which penetrates into the holding chamber from outside.

5. The multipurpose controlled atmosphere heat treatment system as set forth in claim 1, wherein the automatic guided vehicle further comprises a vacuum-purging device for vacuum-purging the holding chamber and an inert-gas feeder for introducing inert gas into the holding chamber and wherein after the holding chamber has been vacuum-purged by the vacuum-purging device, inert gas is introduced into the holding chamber by the inert-gas feeder to create an inert-gas atmosphere in the holding chamber.

6. The multipurpose controlled atmosphere heat treatment system as set forth in claim 1, wherein each of the treatment cells comprises a sealing door on a side facing to the automatic guided vehicle; a vacuum-purging device for vacuum-purging the treatment cell; and an inert-gas feeder for introducing inert gas into the treatment cell.

7. The multipurpose controlled atmosphere heat treatment system as set forth in claim 1 or 6, wherein each of the treatment cells comprises, devices for creating a desired atmosphere in the treatment cell and for controlling the desired atmosphere, said devices being positioned on at least one of a back face, a top, and a front face of said treatment cell whereby adjacent treatment cells contact each other on side faces.

8. The multipurpose controlled atmosphere heat treatment system as set forth in claim 1, wherein each of the treatment cells comprises a heat-insulating material and outer jacketing lagging, and wherein a plurality of treatment cells are disposed in close contact with one another and designed to be independently detachable so that an individual treatment cell is capable of being removed or added.

9. The multipurpose controlled atmosphere heat treatment system as set forth in claim 1, wherein the treatment cells comprises at least one of a heating furnace cell, a carburizing furnace cell, a nitriding furnace cell, an oxidation furnace cell, a tempering furnace cell, an annealing furnace cell, a cooling furnace cell, an oil tank cell, a water tank cell, a salt cell and a cleaning furnace cell.

10. The multipurpose controlled atmosphere heat treatment system as set forth in claim 1, wherein at least one of the treatment cells comprises a hardening oil tank and a hardening holding furnace cell for keeping the workpieces at a specified hardening temperature over a specified time.

11. The multipurpose controlled atmosphere heat treatment system as set forth in claim 1, wherein the shifting means is disposed in the holding chamber and comprises a chain mechanism equipped with a pusher for pushing a tray on which the workpieces are loaded.

* * * * *